US006053522A

United States Patent [19]

Fogarty et al.

[11] Patent Number: 6,053,522

[45] Date of Patent: Apr. 25, 2000

[54] WATER SKI BINDING SYSTEMS

[75] Inventors: Terence Fogarty; Jennifer Leachman, both of Orlando, Fla.

[73] Assignee: A Ski Company, Orlando, Fla.

[21] Appl. No.: 08/933,992

[22] Filed: Sep. 19, 1997

Related U.S. Application Data

[60] Provisional application No. 60/026,406, Sep. 20, 1996.

[51] Int. Cl.[7] ..... B63B 35/81

[52] U.S. Cl. ..... 280/607; 280/624; 441/70

[58] Field of Search ..... 280/607, 14.2, 280/618, 624, 28.14; 441/70

[56] References Cited

U.S. PATENT DOCUMENTS

| | | | |
|---|---|---|---|
| 4,141,570 | 2/1979 | Sudmeier . | |
| 4,673,365 | 6/1987 | Scheurer et al. | 441/70 |
| 4,867,470 | 9/1989 | Clark . | |
| 4,871,337 | 10/1989 | Harris . | |
| 4,964,649 | 10/1990 | Chamberlin . | |
| 5,054,807 | 10/1991 | Fauvet | 280/607 |
| 5,181,332 | 1/1993 | Uren et al. | 36/114 |
| 5,277,635 | 1/1994 | Gillis | 441/74 |
| 5,299,823 | 4/1994 | Glaser | 280/625 |
| 5,505,477 | 4/1996 | Turner et al. | 280/614 |
| 5,553,883 | 9/1996 | Erb . | |
| 5,624,291 | 4/1997 | McClaskey | 441/70 |
| 5,785,566 | 7/1998 | Blanger | 441/70 |
| 5,906,388 | 5/1999 | Neiley | 280/613 |

FOREIGN PATENT DOCUMENTS

| | | |
|---|---|---|
| 0 680 775 A2 | 11/1995 | European Pat. Off. . |
| 1 307 982 | 9/1962 | France . |
| 2 604631 | 4/1988 | France . |
| 2 624 389 | 6/1989 | France . |
| 94 16 208 | 9/1995 | Germany . |
| 96/37270 | 11/1969 | WIPO . |
| 92/18211 | 10/1992 | WIPO . |
| 93/22013 | 11/1993 | WIPO . |
| 95/00387 | 1/1995 | WIPO . |
| 95/09035 | 4/1995 | WIPO . |

OTHER PUBLICATIONS

Favret, Ben, "Equipment: Hard Goods", *Waterski*, Jul. 1997, pp. 70–72.

Advertisement for Goode Ski Technologies, Copyright 1996, 1 pg (doublesided).

Article and order blank on the "FÕGMAN Hard Shell Binding System" by Jennifer Leachman and Terence Fogarty, 4 pgs.

French Advertisement and order form for Skitecnic, "Skiez Avec Les Chausses Skitecnic", 1 pg.

Advertisement of Goode 9100 and PowerShell™ waterskis, 1 pg.

*Primary Examiner*—Lanna Mai
*Assistant Examiner*—Lynda Jasmin
*Attorney, Agent, or Firm*—Finnegan, Henderson, Farabow, Garrett & Dunner, L.L.P.

[57] ABSTRACT

A system for binding hard shell boots to a water ski adjustably attaches the boots to the ski, and can be adjusted by rotation about an axis generally perpendicular to the upper surface of the ski.

31 Claims, 7 Drawing Sheets

WATER SKI BINDING SYSTEMS

RELATED APPLICATION

This application is a continuation-in-part of U.S. Provisional Patent Application Ser. No. 60/026,406, filed Sep. 20, 1996 by the same applicants, which is incorporated herein by reference.

BACKGROUND OF THE INVENTION

1. Field of the Invention

The present invention relates to water skis, hard shell boots, and bindings for attaching hard shell boots to water skis.

2. Description of the Related Art

The length and the width of a water ski define a top surface on which a skier's feet are positioned and supported when being pulled through water by a tow rope attached to a motor boat. Water skis generally have their length or longest direction extending along a longitudinal axis in the direction of motion. The width of the ski, perpendicular to the direction of motion, is generally much smaller than the length. The thickness of the ski extending perpendicular to the top surface of the ski, is generally much smaller than both the length and width.

Some water skis, such as slalom skis, are used by placing both feet on the same ski in tandem, one in front of the other. Other water skis are used by placing each foot on a different ski. In either case, the heel to toe axis of the skier's feet, and boots if used, are aligned generally with the direction of motion of the ski.

Water skis typically use either a soft binding for a skier's foot or a stiff binding for a hard shell boot. Traditional soft bindings are made from rubber, neoprene, or other soft materials that allow the foot and ankle of the skier to have a large degree of flexibility of movement along all axes of motion. These bindings are worn by sliding the foot into a soft enclosure such as a set of straps or a shoe. Some of these bindings may have devices for adjusting the binding to fit the foot of the skier.

Soft bindings allow skiers flexibility in moving and positioning their feet in the bindings for comfort or better effect while performing particular maneuvers. However, this flexibility also allows undesired movement of the leg and ankle of the skier with respect to the ski, making it more difficult to control the ski in high performance situations.

When hard shell boots are used, they are fixed to the skis by bindings that prevent the ankle and lower leg of the skier from rotating, or bending forward, backwards, or sideways, relative to the ski. These hard shell boots and bindings typically are used for highly competitive water skiing, most frequently performed on slalom skis. They permit the skier to more accurately control the angle at which the side of the ski will tack, or bite, into the water and thus allow the skier to perform complicated maneuvers more precisely and reliably than possible with the soft bindings. However, hard shell boots and bindings, unlike soft bindings, do not provide the skier with the flexibility in moving and positioning their feet in the bindings for comfort or better effect while performing particular maneuvers.

SUMMARY OF THE INVENTION

The present invention provides a binding system for skis that addresses the limitations and disadvantages of conventional binding systems for water skis.

The features and advantages of the invention will be set forth in the description which follows, and in part will be apparent from the description, or may be learned by practice of the invention. The features and other advantages of the invention will be realized and obtained by the apparatus and methods particularly pointed out in the written description and claims hereof, as well as the appended drawings.

To achieve these and other advantages and in accordance with the purposes of the invention as embodied and broadly described, the invention includes a binding system for attaching a hard shell boot to a water ski, including a binding attached to the ski and to the boot, for adjustably fixing the ski to the boot, and for permitting rotational adjustments about a vertical axis perpendicular to an upper surface of the ski and to the sole of the boot.

The binding according to the invention gives good control of the ski because side to side leaning of the lower leg of the skier is transmitted to the ski, and can be adjusted to let skiers orient their feet in a preferred position over the ski. This helps the skiers position their feet comfortably on the ski and provides the best turning characteristics.

A further aspect of the invention includes a boot worn by a skier which can be flexed in the front to back direction but which resists flexing in the side to side direction. The binding prevents any relative motion between the boot and the ski around a longitudinal axis of the ski, and prevents separation of the boot from the ski in a direction perpendicular to the ski surface.

Another aspect of the invention includes two boots mounted on a single ski, in tandem, each attached to the ski by at least one binding plate. The boots are adjustably fixed to the ski and allow relative rotatable adjustment between the boot and the ski about a axis perpendicular to the ski surface. This lets each boot be adjustably fixed in a desired orientation on the ski independently of the other boot.

In another aspect, the invention includes a method for mounting a hard shell boot to a water ski, comprising the steps of fixing at least one hard shell boot to a water ski in a first orientation with a binding that maintains the boot adjustably fixed to the ski while allowing adjustments by rotating the boot about an axis perpendicular to the upper surface of the ski; testing the binding orientation by having a skier wear said at least one hard shell boot attached to said water ski; water ski with the boot, binding and ski in that orientation; adjusting the binding to another binding orientation by loosening the binding and rotating the boot about an axis generally perpendicular to an upper surface of the ski by a small angular rotation and fixing the hard shell boot in place in that other binding orientation; and repeating the testing and adjusting steps until a preferred binding orientation is achieved.

In yet another aspect, the invention includes a method for using a water ski binding, comprising the steps of attaching a hard shell boot to a water ski with a binding; loosening the binding to allow rotation between the hard shell boot and the water ski without removing the binding from the hard shell boot and the water ski; optimizing an orientation of the hard shell boot relative to the water ski by rotating the binding about an axis generally perpendicular to the upper surface of the water ski; and securing the binding to prevent rotation of the binding about that axis.

It is to be understood that both the foregoing general description and the following detailed description are exemplary and explanatory only, and are intended to provide further explanation of the invention as claimed.

BRIEF DESCRIPTION OF THE DRAWINGS

The accompanying drawings are included to provide a further understanding of the invention and are incorporated in and constitute a part of this specification, and describe several embodiments of the invention, and together with the description serve to explain the principles of the invention. In the drawings.

DESCRIPTION OF THE PREFERRED EMBODIMENTS

Figure 1:
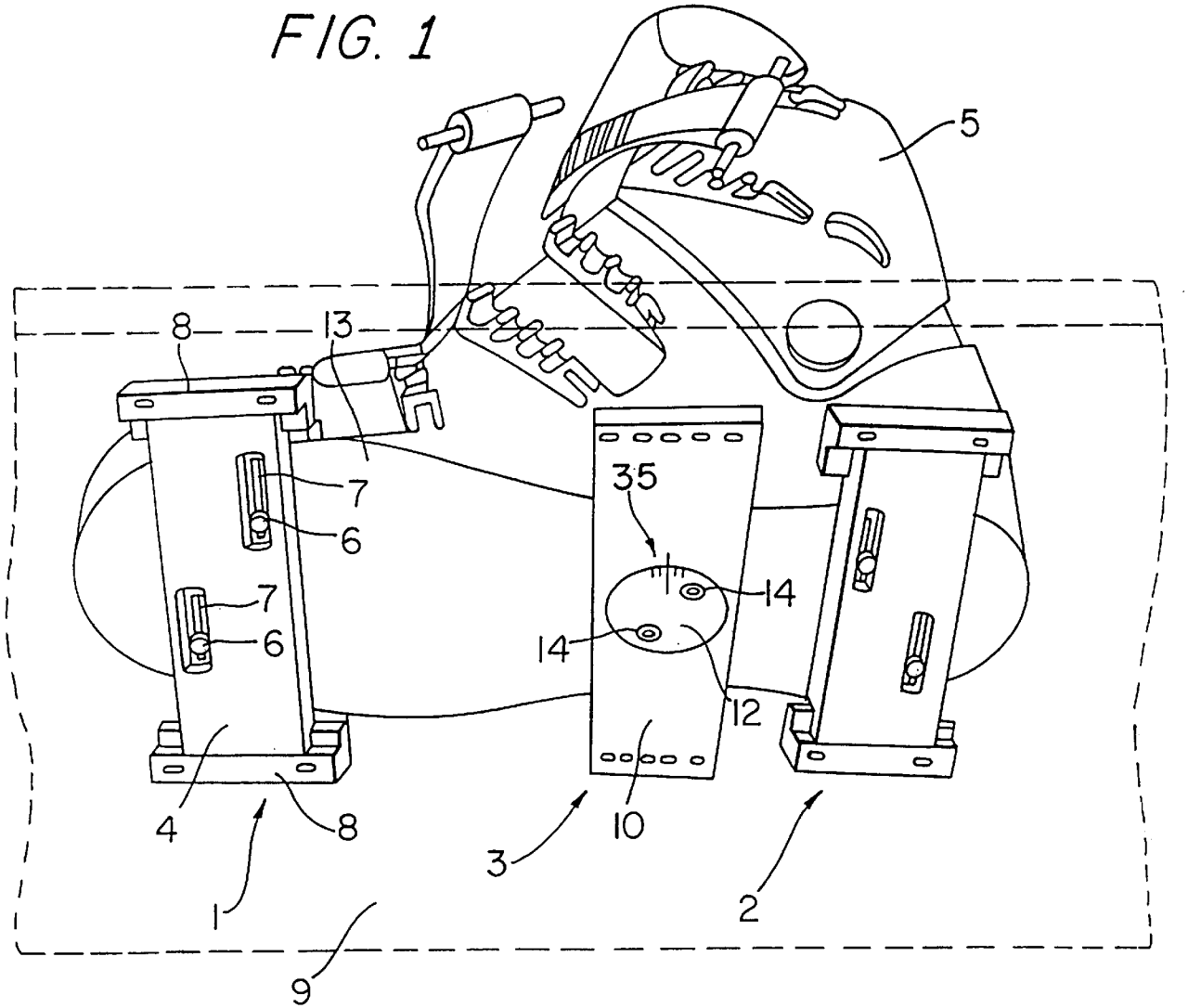
FIG. 1 is a bottom perspective view of one embodiment of the binding system, showing a hard shell boot and a set of binding plates.
Figure 2:
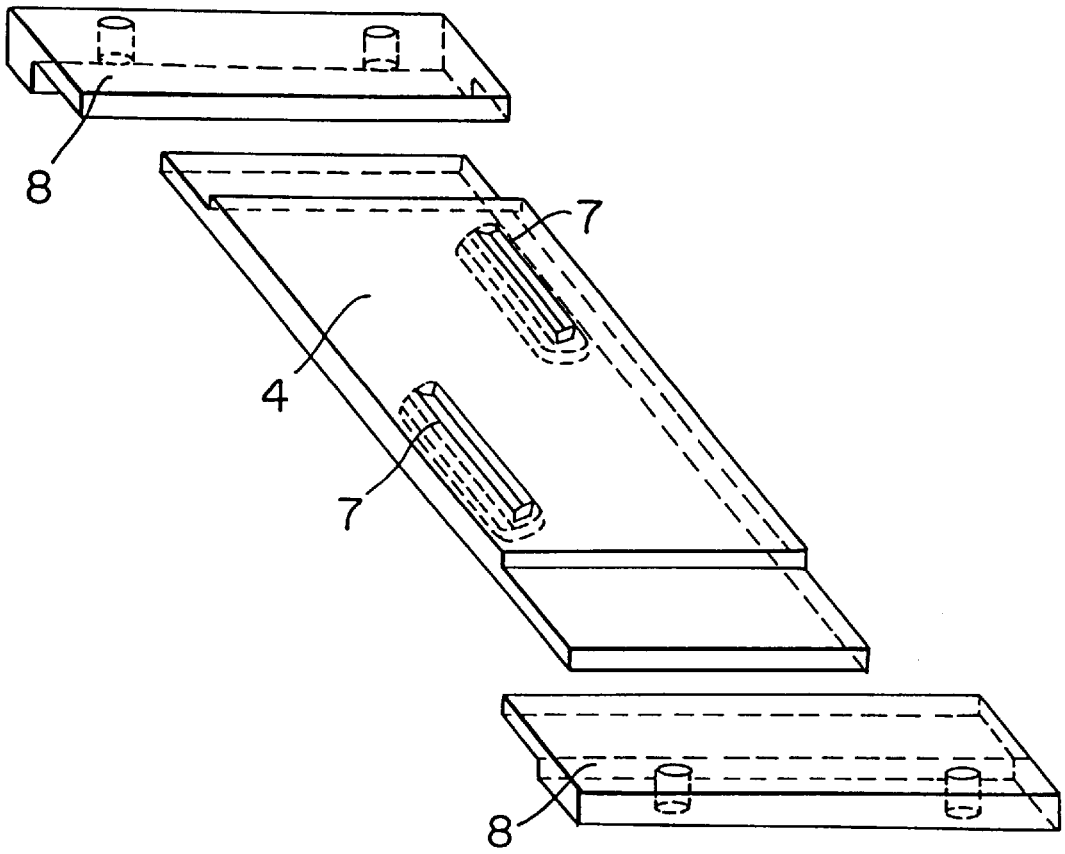
FIG. 2 is a perspective view showing one of the binding plates of FIG. 1.

Reference will now be made in detail to the present preferred embodiments of the invention, examples of which are described in the accompanying specification and are illustrated in the accompanying drawings.

While the present invention can be generally applied in the field of water ski bindings, it is especially well suited for use in water ski bindings that are used in slalom skis where both feet of the skier are secured to one single ski, by a combination of hard shell boots and bindings placed on the ski in tandem.

The present invention permits attaching a hard shell boot to a water ski in the manner which prevents sideways motion of the leg and ankle of the skier. Additionally, the ski is allowed to flex normally during turns, and the bindings allow the boot to be adjusted within certain limits according to the preference of the skier. The boot may be constructed to allow front to back flexing of the leg of the skier with respect to the ski.

Preventing side to side motion of the boot relative to the ski enables the skier to better control the angle at which the ski cuts into the water, since any left to right pivoting of the skier's lower leg is transmitted directly to the ski.

In accordance with one aspect of the invention, the binding system attaches a hard shell boot to a water ski by using binding plates positioned between the boot and the ski, which prevent rotation of the boot in the longitudinal axis with respect to the ski. A skier could use the bindings of the invention with slalom skis, where only one ski is used, and both right and left boots are attached to the single ski in tandem. The skier can then fit his feet in the boots, with the right or the left foot forward, depending on the skier's preference.

The boots can be placed on the ski in various angular orientations relative to each other and to the center line of the ski. For example, the boots can be placed in an open stance, with the toes of the rear foot diverging from the ski centerline. In that arrangement, if the left foot is placed forward along the center line of the ski, the toe of the right foot would be pointed slightly to the right of the centerline and the heel of the right foot to the left, rather than parallel to the centerline. The open stance gives some skiers better control in weak side turns. If the skier prefers, the boots may be placed in a closed stance with the rear boot pointed in the opposite direction with respect to the ski centerline. Depending on the preference of the skier, either left or right boot can be placed in front of the other on the ski, and either an open or closed stance can be achieved.

When using slalom skis, the invention permits a skier to finely tune the orientation of both the front and rear boots with respect to the ski centerline. Depending on the skier's preference and on the maneuvers to be performed on the skis, the skier may adjust the orientation of the front boot, the rear boot, or both boots by a small amount, by rotating them about an axis perpendicular to the top surface of the ski. According to the invention, each binding allows to rotatably adjust the corresponding boot around that axis, while preventing vertical separation of the boot sole from the ski surface, and preventing the boot from twisting in a side to side direction relative to the ski. Once the adjustment is performed and the binding is resecured, the binding prevents further rotation of the boot on the ski during use. Continuous adjustability and very small increments of adjustability can be obtained, such as increments of one-sixteenth of an inch.

As embodied herein, and as shown in FIG. 1, a hard shell rigid ski boot 5 is attached to a water ski 9 by means of binding plates 1, 2, and 3. Plate 1 is positioned at the front end of the sole 13 of boot 5, and binding plate 2 is positioned near the heel of boot 5. Binding plate 3 is located approximately half-way between the toe and the heel of the boot, and defines the center of rotation of the boot on the ski. The three plates attach the boot to the ski along a large portion of the sole 13, so that bending of boot 5 in a side to side direction is resisted.

The use of multiple small plates is advantageous over using only one larger plate, because it lets the ski bend more easily. In a turn, the ski tends to bend like a bow because of water pressure on its underside, so that the front and rear ends of the ski are bent towards the skier. If a single binding plate having the length of the boot is attached to the upper surface of the ski, this bending will be impeded by the plate. The ski will thus not be able to negotiate a turn as well as a ski with the present bindings.

Binding plate 1 is formed by a plate 4 having two slots 7 cut in a lateral direction along plate 4. Studs 6 are securely attached to the sole 13 of the boot, and extend in slot 7 in a manner which prevents the sole 13 from separating from plate 4, and maintains the sole substantially parallel to the plate, while allowing sliding of the sole over plate 4. Studs 6 can be tightened to prevent the sliding of sole 13 over plate 4 once the bindings are in the desired position.

Brackets 8 are securely fastened to the top surface of the ski 9, but allow a sliding movement of plate 4 in the direction of length of the ski. This movement allows the front part of the boot to move with respect to the ski along the length of the ski, and together with the feature of separate binding plates of small size, gives the ski an even more unrestricted ability to bend while negotiating a turn.

Binding plate 2 has an identical structure to binding plate 1. It also allows movement of the heel of boot 5 along the length of slot 7, and allows translation of the heel of the boot along the length of the ski. As in binding plate 1, studs 6 engage slots 7 so that the heel of boot 5 can be pointed right and left from the ski centerline when the studs are loosened, but the heel cannot be lifted from the ski, and cannot be twisted in a side to side direction.

Figure 3:
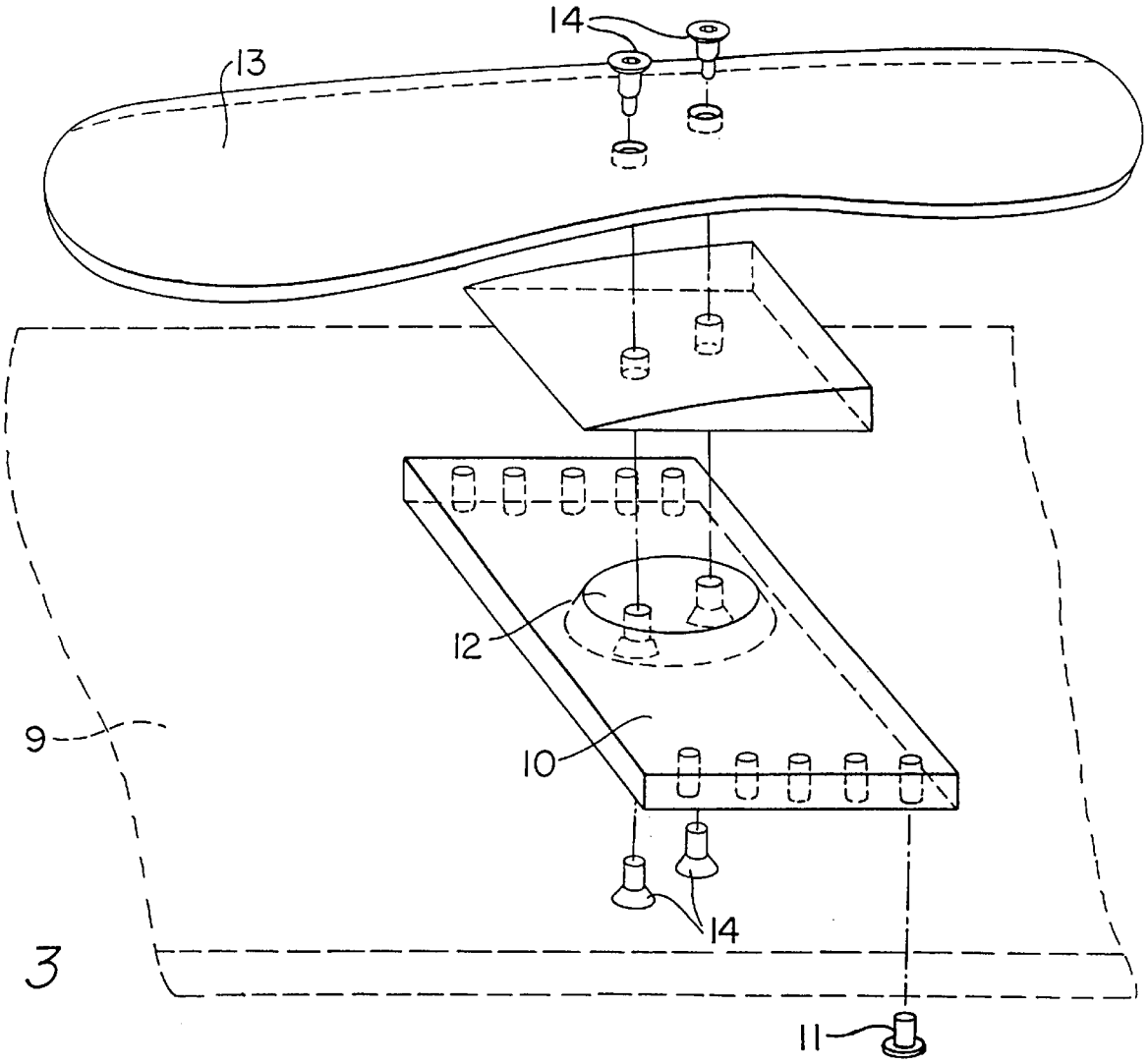
FIG. 3 is a perspective view showing another of the binding plates shown in FIG. 1.

In FIG. 3, the central binding plate is shown in greater detail. Plate 10 is attached to ski 9 by using fasteners such as screws 11. A rotating portion 12 of the binding plate 3 is disposed in the middle of plate 10, and is securely fastened to the sole 13 of the boot by means of fasteners such as screws 14. This binding plate permits boot 5 to rotate about an axis perpendicular to the surface of the ski, but does not allow any translation, lateral bending, nor rotation of the boot about the longitudinal axis of the ski. The combination of the rotation allowed by binding plate 3 and the sliding of studs 6 within slot 7 of binding plates 1 and 2 permits the entire boot to be adjusted by rotation about an axis perpendicular to the ski surface, within angular limits defined by the length of slot 7. Once the boot is in the proper orientation, the binding is tightened to maintain that orientation while skiing. The boot as a whole cannot translate along the length of the ski, but due to the method of attachment of binding plates 1 and 2, the tip and heel of the boot can translate with respect to the ski, and therefore allow bending of the ski when the skier performs a turn.

Attaching studs 6 can be screws or other fasteners which can be tightened at the desired angular position of rotation of the boot with respect to the ski. A graduated indicator 35 can be used to measure this angular position. In this manner, when the fasteners are loose the skier can easily position the front and rear boots on the ski in the desired orientation, which can be determined by testing the bindings in various orientations. When the boots are in the desired orientation, the fasteners are tightened, to securely hold the boots in that orientation while skiing.

It is also desirable for the skier to be able to pivot forward his lower legs in a front to back direction while skiing. This ability lets the skier position himself to perform certain maneuvers on the skis. According to the invention, the hard shell boots can be flexed in a front to back direction, while resisting flexing in a side to side direction.

As embodied herein, and referring to FIG. 1, boot 5 can flex in the forward and backward direction about a lateral axis of the boot and of the ski. The boots can be of conventional design, and this flexibility can be achieved by having the boot made of two or more components hinged to each other, or by providing slots or openings on the instep portion of the boot, so that the front portion of the boot will be able to flex towards the rear portion of the boot. Boot 5 is constructed as a hard shell, so that it will not bend or flex in the side to side direction, around a longitudinal axis of the boot and of the ski, and is also designed to securely hold the foot and ankle of the skier so that the plant of the foot of the skier remains parallel with the surface of the ski.

Figure 4:
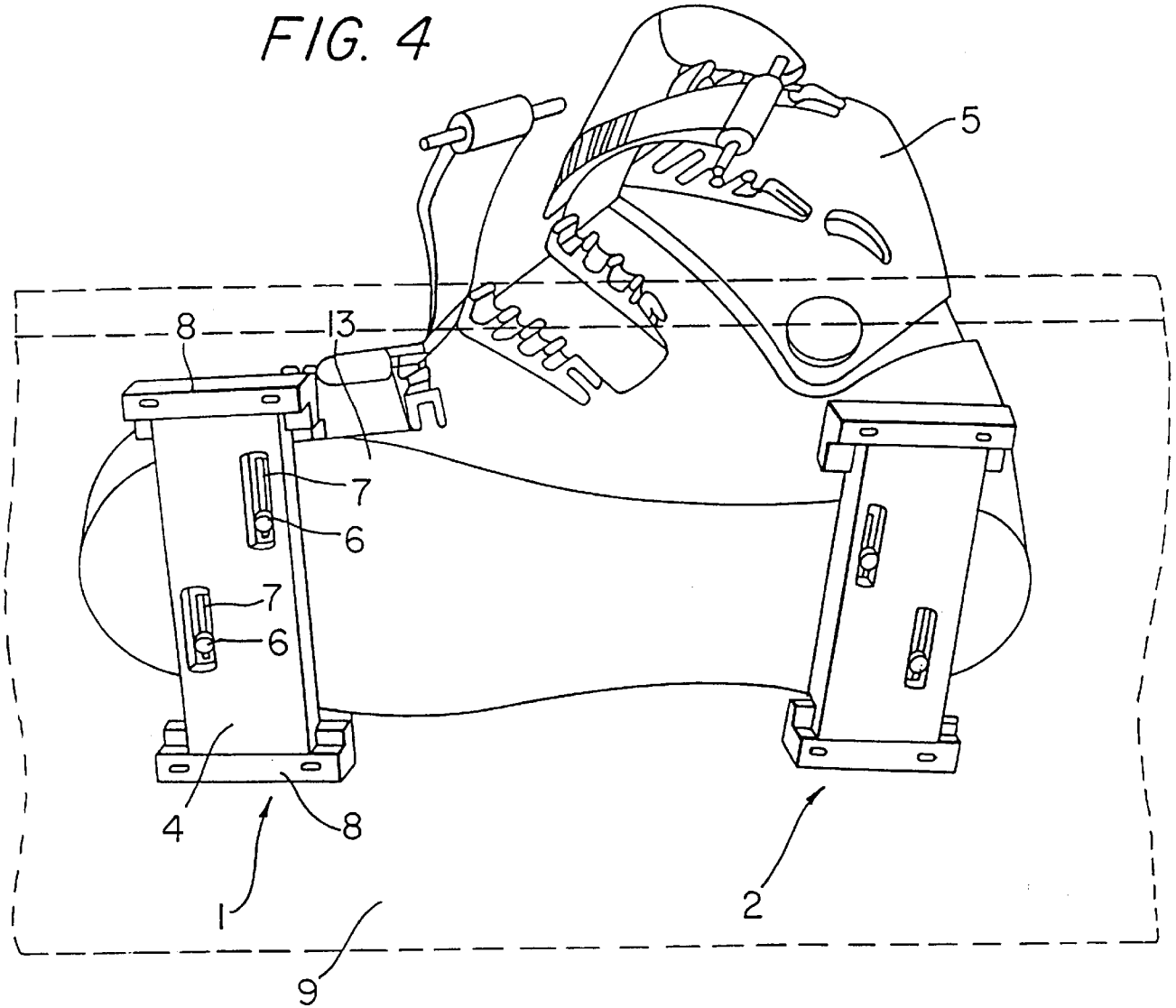
FIG. 4 is a bottom perspective view showing a second embodiment of the invention.

In FIG. 4, a second embodiment of the binding is shown, where only two attachment plates are used. One plate is at the front of the boot, and another at the rear of the boot. Both binding plates 1 and 2 have a construction similar to the binding plates at the tip and heel of the first embodiment, so that boot 5 is allowed to rotate about an axis perpendicular to the surface of the ski by studs 6 sliding within slots 7 of the plates 4. This configuration also allows bending of the ski because the plates 4 can slide within brackets 8, and because the plates are short. Both front and rear portions of the boot can translate laterally on the ski surface along the slots in the binding plates as well as rotate as a unit, but the rotation does not occur about a fixed center.

A different construction of the binding can be obtained by eliminating the brackets that retain the plates of the bindings in contact with the top ski surface and allow the plates to translate along the ski length. However, if the plates are attached to the ski directly, it is still necessary to provide for translation of at least one end of the boot along the ski length, to permit bending of the ski. This can be accomplished by utilizing at one end of the boot a binding made of two plates, maintained one above the other, which can slide relative to one another within certain limits. This configuration also makes it easy to adjust the bindings without having to disassemble the binding from the ski and boot.

According to the invention, the binding system comprises a front binding plate attaching the front of the boot to the ski, and top and bottom rear binding plates generally parallel to the ski surface and to each other, which cooperate to attach the heel of the boot to the ski.

Figure 5:
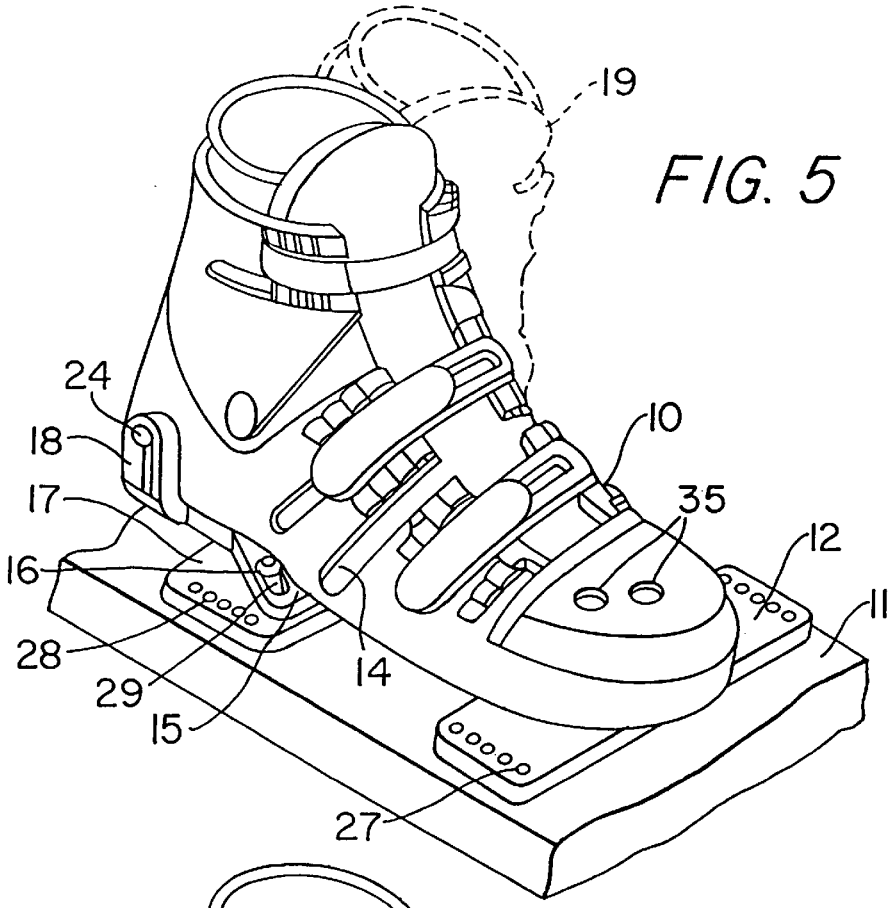
FIG. 5 is a perspective view showing a third embodiment of the invention having a boot, a ski, and binding plates.

As embodied herein, and with reference to FIG. 5, a third embodiment of the invention is described. This embodiment includes a hard shell boot 10 which is connected to a water ski 11 by a front binding plate 12 and by a pair of rear binding plates 17 and 15. Boot 10 is flexible in the front to back direction as shown by the dashed lines 19, however, it is stiff in the side to side direction to prevent the skier's foot and ankle from twisting around the longitudinal axis of the boot and of the ski. The front to back flexibility necessary for proper positioning of the skier's legs can be achieved by cutting slots 14 in the material of the boot instep region, without reducing the side to side stiffness of the boot. As used in this description, a hard shell boot may be an in line skate boot having a hard shell plastic surface or another type of stiff boot which provides similar support, for example a boot with reinforcements, in a form other than a hard shell plastic surface, that prevents side to side flexing.

Figure 6:
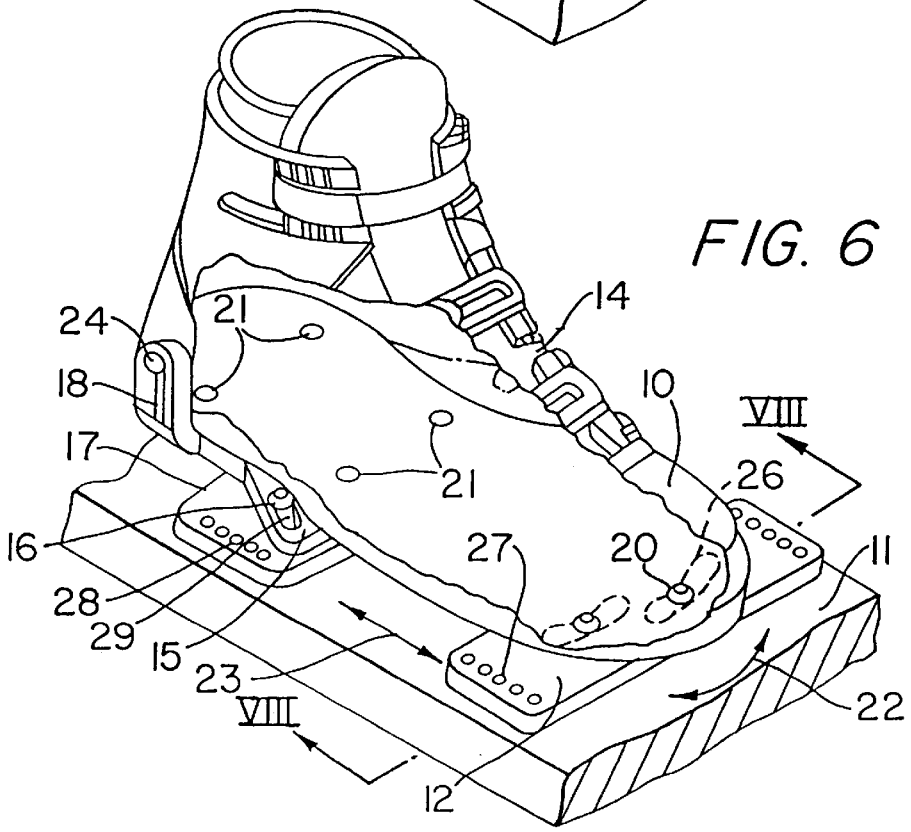
FIG. 6 is a cut out perspective view showing the fasteners connecting the binding plates to the boot of FIG. 5.
Figure 8:
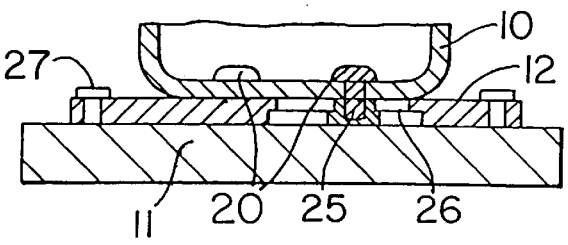
FIG. 8 is a cross section on line VIII—VIII of FIG. 6, showing a detail of the attachment between the boot and the ski using a binding plate.
Figure 7:
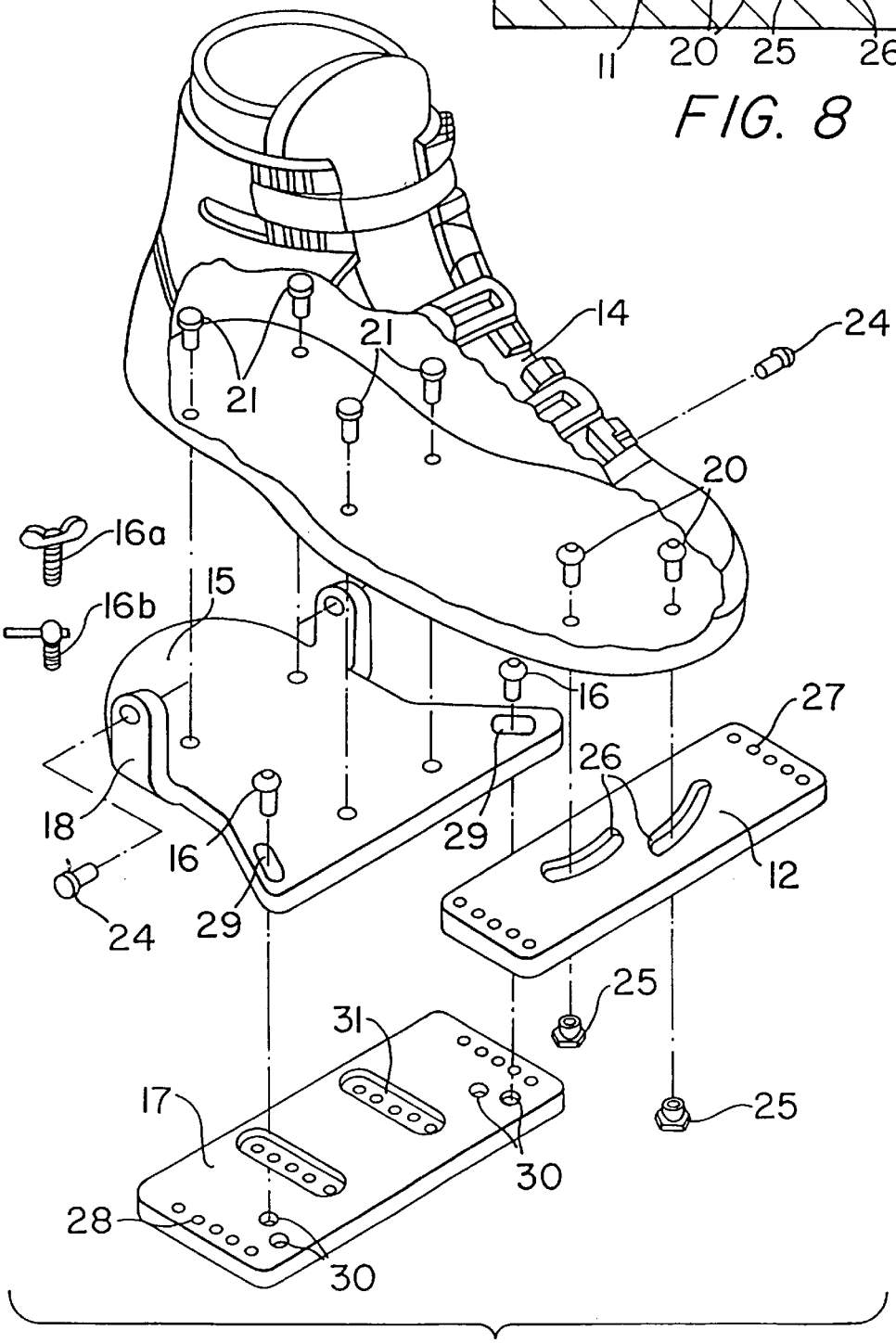
FIG. 7 is an exploded view showing the binding system of FIG. 5.

FIGS. 6 to 8 show a detail of the connection between the front and the rear binding plates and the ski and boot. The rear attachment includes a bottom plate 17 which is securely attached to the ski 11 by means of fasteners which can be screws or bolts extending through perforations 28 and 31. The top rear binding plate 15 is securely connected to the sole of boot 10, by fasteners 21 which may be screws, rivets, or bolts. In addition, two lateral heel support brackets 18 extend upwardly from the edges of plate 15, and are secured to the sides of the hard shell boot 10 by means of fasteners 24, which may be rivets or screws. This arrangement provides additional support and stiffness to prevent side to side movement of the boot with respect to the ski, and helps to maintain the skiers lower leg perpendicular to the ski, with the foot of the skier parallel to the top surface of the ski.

Top rear binding plate 15 is provided with two slots 29. Fasteners 16, 16*a*, or 16*b* are threaded into holes 30 of the bottom rear binding plates 17, so that they can slide within slots 29. Fasteners 16, 16*a* or 16*b* can be, for example, machine screws that can be fastened and unfastened while the boot is mounted on the ski.

Fasteners 16 have a head that require a tool such as a screw driver or wrench to loosen and tighten them. Alternative fastener 16*a*, a winged screw, and fastener 16*b*, a screw with a built-in handle, can be loosened and tightened by hand and do not require a tool for such efforts. Other quick release fasteners, or other fasteners, can alternatively be used. Using these bindings with such fasteners is simple, since the skier only has to fasten the binding to the ski and the boot, and then adjust the binding to the desired rotational orientation of the boot. Once the adjustment is completed, the skier secures the binding to prevent further rotation, and is ready to ski. A binding can be constructed such that the skier may be permitted to unlock the binding and adjust the orientation of the boots while skiing.

This binding arrangement allows the boot to move with respect to the ski, within the limits allowed by the size and placement of slots 29. A plurality of holes 30 is provided in bottom plate 17 so that the desired relationship between the top plate 15 and bottom plate 17 can be obtained. This arrangement can be utilized to set the boots in an open or closed stance. For example, an open stance is obtained by securing the right fastener 16 of the right rear boot to the rear hole 30, and securing the left fastener 16 to the front hole 30. Fasteners 16 may be secured in diagonally opposite holes 30 for movement and adjustment in the opposite direction.

According to one aspect of the invention, the holes and slots are oriented so that the furthest rotational adjustment of the boot in the direction of the most forward fastener 16 coincides with a boot orientation along the centerline, parallel to the ski length. This feature permits fast and easy orientation of the boot along the centerline and parallel to the ski length.

A plurality of fastener holes 31 and 28 is also provided for properly positioning the binding plates along the length of the ski. This adjustment is useful for setting the distance between the binding plates of the front and rear boots, and to fit the bindings to boots of different sizes.

The front portion of the binding is comprised of plate 12 which is secured to the ski by fasteners which fit through perforations 27. A plurality of holes 27 are provided for properly positioning the front binding plate and fitting different boots. Two slots 26 are cut in front binding plate 12, and are shaped to permit left to right movement of the front of boot 10 with respect to the ski. As shown in FIG. 8, bolts 20 extend from the inside of sole of boot 10 through slot 26 of front plate 12, and thread into nuts 25 to prevent the sole of boot 10 from lifting away vertically from plate 12, while allowing for horizontal movement within slots 26. Nuts 25 are "I" nuts, having an extended sleeve which acts as a bearing surface within slot 26.

The combination of nut 25 and bolt 20 can be set to selectively fix the unit in place. The combination can also be loosened or set to slide within slot 26 while the unit is assembled, so that the binding can be loosened for adjustment without having to remove the boot from the ski simply by releasing fasteners 16. As shown in FIG. 5, holes 35 can be provided in the shell of boot 10 so that after removing the boot liner, a screwdriver or wrench can engage the head of screw 20 to loosen and tighten the combination of nut 25 and bolt 20, without disassembling the boot, binding, and ski. Other alternative elements or arrangements of elements may also be used for securing the boot, binding, and ski.

The size and shape of slots 26 and 29 permit adjustment of the boot 10 by rotation along an axis perpendicular to the surface of the ski, while preventing any side to side twisting of the boot, or lifting of the sole of the boot from the upper surface of the ski. A small amount of translation forward and backward along the length of the ski is also allowed, which together with the small size of the plates, accommodates bending of the ski during a turn.

The slots on the front and rear binding plates allow the front and rear portions of the boot to rotate as a unit, and thus are cut along arcs of circles centered at the point of rotation of the entire boot. It is also possible to achieve the same result by forming the slots with straight sides, and building in sufficient play between the sides of the slots and the projections extending into the slots, so that the desired rotation of the boot can be obtained.

The bindings of this invention can be used on different types of skis, other than slalom skis. For example, the bindings can fit on "trick" skis, where a front binding secures a skier's foot to the single ski, while the other foot is loosely held to the ski by a strap or similar device. The front foot remains attached to the ski while skiing, but the rear foot can be freed, to perform certain maneuvers, or "tricks," while skiing.

Figure 9:
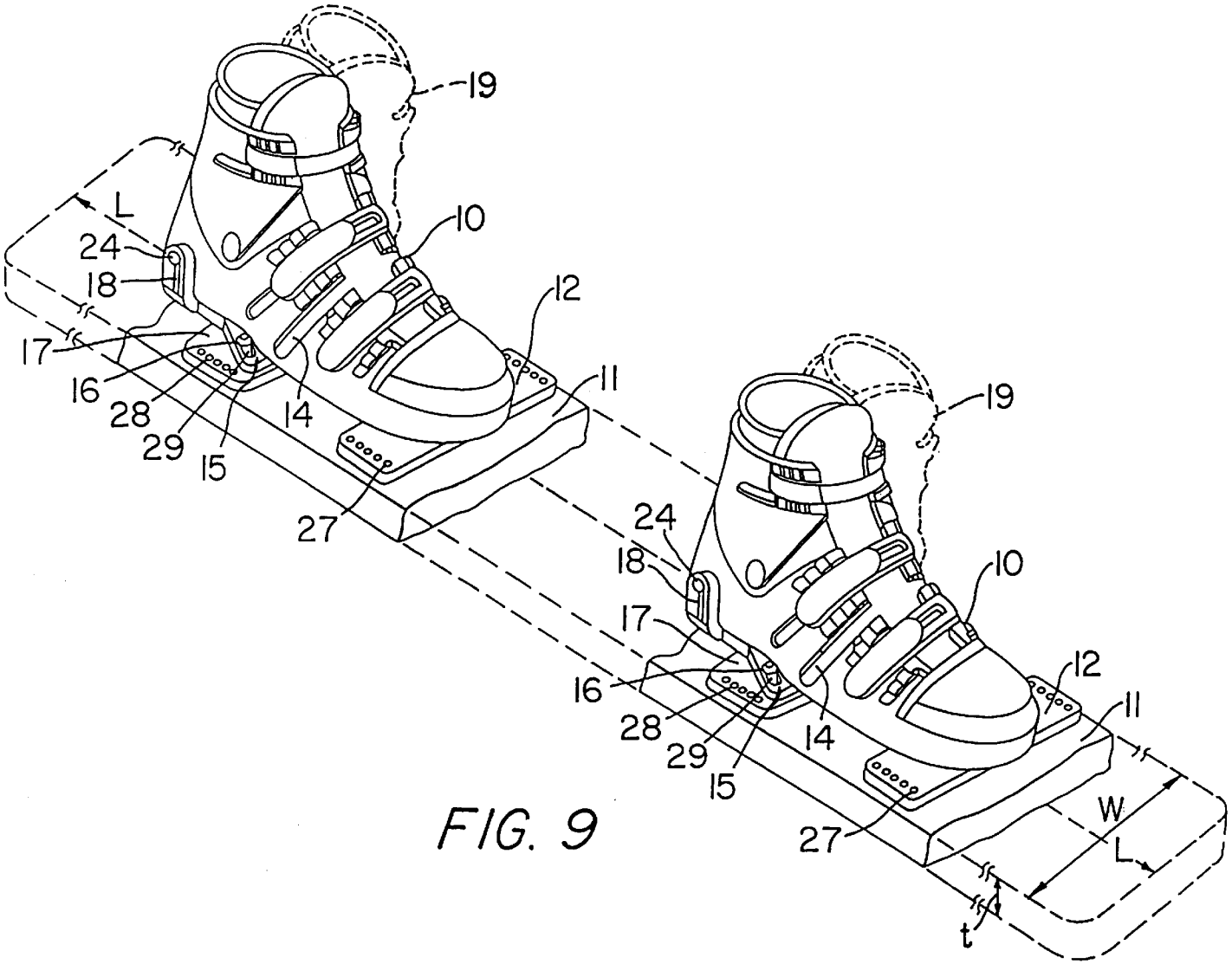
FIG. 9 is a perspective view showing an embodiment of the invention where two boots are mounted in tandem on one ski.

FIG. 9 shows one example of right and left boots being attached to a single ski, in tandem, using the bindings of the present invention.

Another embodiment of the invention, in accordance with the invention, describes a method for optimizing the mounting of hard shell boots to water skis using bindings which maintain the boot adjustably fixed to the ski, and allow rotational adjustment of the boot along an axis generally perpendicular to the ski. The adjustment can be performed without removing the boot or binding from the ski. As embodied herein, and referring to FIG. 6, binding plates 12 and 17 are attached to ski 11 by means of fasteners. Boot 10 is attached to front binding plate 12 by means of projections 20 fitting in slots 26, and is also attached to top rear binding plate 15 by means of fasteners 21. The top rear binding plate 15 is attached to bottom rear binding plate 17 by projections 16 fitting in slots 29.

Initially the bindings may be set so that the longitudinal axis of boot 10 is parallel to the longitudinal axis of ski 11. The orientation of the binding is then tested by having a skier ski with the bindings adjusted in that orientation. The boots are then rotated with respect to the skis by a small amount, made possible by the continuous range of adjustments provided to the bindings by the slots and projections design. The skier repeats the testing of the bindings, until a satisfactory setting is found. Indexing marks can be provided to help set or record the adjustments. The bolt-nut combination 20–25 remains free to slide within slots 26 of the front binding plate 12, so the adjustments to the binding can be performed after simply loosening fasteners 16, without removing the boot or binding from the ski. Fasteners 16 are tightened for use after adjustment, thus preventing further rotation of the boot and binding.

The skier can perform these adjustments to only the binding for the rear boot, leaving the front boot binding aligned with the ski length, or the orientation of both front and rear boot bindings may be optimized, since both front and rear boot bindings may have the same design. The bindings may be adjusted to either a closed stance, open stance, or otherwise such as with both boots parallel to the ski length, depending on skier preference.

Also depending on the preference of the skier, the adjustment of the rotational orientation of the boots with respect to the skis may be performed by moving the heel, the toe, or both parts of the boot. One set of end positions for the adjustment travel can be provided to define an orientation of the boots parallel to the skis, so that it is easy and fast to obtain that orientation. Other positions can also be defined in a similar manner, to rapidly orient the boot in those positions.

During optimization of the binding orientation, the fasteners that slide within the slots of the binding plates are loosened, to permit rotation of the boots to a new orientation only before or after skiing. The fasteners are tightened before skiing, so that the binding immobilizes the boot on the ski in the desired position during skiing.

The bindings and method for optimizing the orientation of the bindings of this invention provide more comfort and control over the skis, especially in a turn, by maintaining the feet of the skier parallel to the ski surface, and preventing rotational and side to side movement of the lower leg while allowing forward to back movement. In particular, slalom skis and trick skis benefit from using these bindings.

Soft bindings, including those with foot supports having straps or soft rubber boots extending from a binding support such as a mounting plate, can be constructed with rotational adjustments on their mounting plates similar to those on the hard shell boot bindings. The adjustable soft bindings can be used in the same way to improve the comfort, performance, and turning characteristics of those water ski systems.

It will be apparent to those skilled in the art that various modifications and variations can be made in the structure and the methodology of the present invention without departing from the spirit or scope of the invention. Thus, it is intended that the present invention cover the modifications and variations of this invention provided they come within the scope of the appended claims and their equivalents.

What is claimed is:

1. A water ski binding system comprising:

a water ski having an upper surface and a length;

at least one hard shell boot positioned on the upper surface of the water ski, said hard shell boot having a length; and a binding rotatably coupling the water ski and the hard shell boot, said binding configured to position the hard shell boot on the upper surface of the water ski and permit rotational adjustments of the hard shell boot relative to the water ski about an axis generally perpendicular to the upper surface of the water ski, wherein the length of said hard shell boot is oriented in substantially the same direction as the length of the water ski.

2. The binding system of claim 1, further comprising markings on the binding indicating the orientation of the boot relative to the ski.

3. The binding system of claim 1, wherein the boot has elongated openings perpendicular to the length of the boot, open in the instep area of the boot, to allow forward and backward flexing of the boot.

4. The binding system of claim 1, wherein the binding adjustably fixes two hard shell boots in tandem on one ski.

5. The binding system of claim 1, wherein the binding adjustably fixes the boot in an orientation generally parallel to a direction of motion of the ski.

6. The binding system of claim 1, wherein the water ski is a slalom ski.

7. The binding system of claim 1, wherein the water ski is a trick ski.

8. A water ski binding system comprising:

a hard shell boot support;

a hard shell boot attachment for attaching the support to a hard shell boots said hard shell boot having a length oriented substantially in the same direction as a length of the water ski;

a water ski attachment for attaching the support to the water ski; and means for permitting the hard shell boot attachment to be rotatably adjusted and fixed relative to the water ski attachment to permit rotational adjustments, of a hard shell boot relative to a water ski about an axis generally perpendicular to an interface between the hard shell boot and the water ski.

9. A water ski binding system comprising:

a water ski having an upper surface;

at least one hard shell boot positioned on the upper surface of the water ski, said hard shell boot having a length oriented substantially in the same direction as a length of the water ski; and a binding attached to the water ski and to the hard shell boot for fixing the hard shell boot to the water ski and permitting rotational adjustments of the hard shell boot relative to the water ski about an axis generally perpendicular to the upper surface of the water ski, wherein the binding includes separate front and rear binding plates for respectively attaching front and rear portions of the boot to the ski and for permitting the front and rear portions of the boot to flex relative to each other.

10. A water ski binding system comprising:

a water ski having an upper surface;

at least one hard shell boot positioned on the upper surface of the water ski, said hard shell boot having a length oriented substantially in the same direction as ,a length of the water ski; and a binding attached to the water ski and to the hard shell boot for fixing the hard shell boot to the water ski and permitting rotational adjustments of the hard shell boot relative to the water ski about an axis generally perpendicular to the upper surface of the water ski, the binding including a front binding plate for attaching the front of the boot to the ski, and top and bottom rear binding plates substantially parallel to the upper surface of the ski and to each other that cooperate for attaching a heel of the boot to the ski, allowing rotational motion of the boot about said axis.

11. The binding system of claim 10, further comprising lateral heel support brackets extending from the top rear binding plate and fastening to right and left portion of the boot above the sole, for maintaining the sole of the boot substantially parallel to the upper surface of the ski.

12. The binding system of claim 10, wherein the front binding plate is attached to the ski and has slots for receiving projections from the boot which can slide in the slots, the bottom rear binding plate is attached to the ski, and the top rear binding plate is attached to the boot and has slots for receiving projections from the bottom rear plate, so that said slots and projections maintain the rear binding plates in a parallel relationship.

13. The binding system of claim 12, wherein the bottom rear plate has two projections extending upwards and fitting in corresponding slots formed in the top rear plate.

14. The binding system of claim 12, wherein the top and bottom rear binding plates can slide one over the other to permit rotation of the boot about said axis and translation of the heel along the length of the ski.

15. The binding system of claim 12, wherein the slots of the front and rear binding plates cooperate with the projections extending into the slots, to let the boot be adjusted relative to the ski in a continuous range of rotational positions, limited by the projections abutting edges defining the slots.

16. The binding system of claim 12, wherein the projections from the bottom rear plate abut an edge defining the slot of the top rear plate at a rotational adjustment position of the boot parallel with the ski length.

17. A water ski binding system comprising:

a water ski having an upper surface;

at least one hard shell boot positioned on the upper surface of the water ski, said hard shell boot having a length oriented substantially in the same direction as a length of the water ski; and a binding attached to the water ski and to the hard shell boot for fixing the hard shell boot to the water ski and permitting rotational adjustments of the hard shell boot relative to the water ski about an axis generally perpendicular to the upper surface of the water ski, wherein the binding is formed of multiple binding plates, to avoid interfering with bending of the ski.

18. A method for mounting a hard shell boot to a water ski, comprising the steps of:

fixing at least one hard shell boot to a water ski in a first orientation with a binding that maintains the boot adjustably fixed to the ski while allowing adjustments by rotating the boot about an axis perpendicular to the upper surface of the ski;

testing the binding orientation by having a skier wear said at least one hard shell boot attached to said water ski with the boot, binding and ski fixed in that orientation;

adjusting the binding to another binding orientation by loosening the binding and rotating the boot about an axis generally perpendicular to an upper surface of the ski by a small angular rotation and fixing the hard shell boot in place in that other binding orientation; and repeating the testing and adjusting steps until a preferred binding orientation is achieved.

19. The method of claim 18, wherein the steps are carried out for a right boot and binding combination, and for a left boot and binding combination.

20. The method of claim 19, wherein both left and right boots are attached to one ski.

21. A method for using a water ski binding, comprising the steps of:

attaching a hard shell boot to an upper surface of a water ski with a binding;

loosening the binding to allow rotation between the hard shell boot and the water ski without removing the binding from the water ski;

optimizing an orientation of the hard shell boot relative to the water ski by rotating the binding about an axis generally perpendicular to the upper surface of the water ski; and securing the binding to prevent rotation of the hard shell boot about the axis.

22. A water ski binding system comprising:

a water ski having an upper surface;

at least one hard shell boot positioned on the upper surface of the water ski, said at least one hard shell boot having a length oriented substantially in the same direction as a length of the water ski; and a binding attached to the water ski and to the hard shell boot for fixing the hard shell boot to the water ski while permitting rotational adjustments of the hard shell boot relative to the water ski about an axis generally perpendicular to the upper surface of the water ski, wherein the binding includes separate front and rear binding plates for respectively attaching front and rear portions of the hard shell boot to the water ski and for permitting the front and rear portions of the hard shell boot to flex relative to each other.

23. The binding system of claim 22, wherein the boot has elongated openings perpendicular to the length of the boot, open in the instep area of the boot, to allow forward and backward flexing of the boot.

24. A water ski binding system comprising:

a binding support;

a binding attachment for attaching the binding support to a foot support;

a water ski attachment for attaching the binding support to a water ski; and means for permitting the binding attachment to be rotatably adjusted and fixed relative to the water ski attachment to permit rotational adjustments of a foot support relative to a water ski about an axis generally perpendicular to an interface between the foot support and the water ski.

25. The binding system of claim 24, including a foot support formed of a soft material.

26. A slalom water ski binding system comprising:

a slalom water ski having an upper surface and a length;

at least one hard shell boot positioned on the upper surface of the slalom water ski, said hard shell boot having a length; and a binding rotatably coupling the slalom water ski and the hard shell boot, said binding configured to position said hard shell boot on the upper surface of the slalom water ski and permit rotational adjustments of the hard shell boot relative to the slalom water ski about an axis generally perpendicular to the upper surface of the water ski, wherein the length of said hard shell boot is oriented in substantially the same direction as the length of the water ski.

27. A water ski binding system comprising:

a water ski having an upper surface, the upper surface having a length;

at least one boot positioned on the upper surface of the water ski, said boot having a length; and a binding rotatably coupling the water ski and the boot, said binding configured to position said boot on the upper surface of the water ski and permit rotational adjustments of the boot relative to the water ski about an axis generally perpendicular to the upper surface of the water ski, wherein the length of said boot is oriented in substantially the same direction as the length of the water ski.

28. The water ski binding system of claim 27, wherein the boot is formed of a relatively soft material.

29. A water ski binding system comprising:

a water ski having an upper surface and a length;

a binding attached to the water ski upper surface; and a boot having a length and configured to be rotatably coupled to the binding so as to permit the boot to rotate about an axis generally perpendicular to the water ski upper surface, wherein the length of the boot is oriented in substantially the same direction as the length of the water ski when the boot is coupled to the binding.

30. The water ski binding system of claim 29, wherein the boot is formed of a relatively soft material.

31. A water ski binding system comprising:

a water ski having an upper surface and a length;

a binding attached to the upper surface of the water ski, said binding configured to couple a boot to the water ski upper surface and to permit rotational adjustments of the boot relative to the water ski about an axis generally perpendicular to the upper surface of the water ski, wherein said binding is further configured to couple the boot so as to orient a length of the boot in substantially the same direction as the length of the water ski.

* * * * *